United States Patent [19]

Rosen

[11] Patent Number: 4,510,091

[45] **Date of Patent: * Apr. 9, 1985**

[54] CONTINUOUS REDUCTION OF EDIBLE OILS

[75] Inventor: Bruce I. Rosen, Skokie, Ill.

[73] Assignee: UOP Inc., Des Plaines, Ill.

[ * ] Notice: The portion of the term of this patent subsequent to May 24, 2000 has been disclaimed.

[21] Appl. No.: 360,071

[22] Filed: Mar. 19, 1982

[51] Int. Cl.[3] ..... C11C 3/12

[52] U.S. Cl. ..... 260/409; 502/335

[58] Field of Search ..... 260/409; 252/472, 466 J, 252/461, 459; 502/335

[56] References Cited

U.S. PATENT DOCUMENTS

| | | | |
|---|---|---|---|
| 2,971,016 | 2/1961 | Szabo et al. | 260/409 |
| 3,123,626 | 3/1964 | Kirsch | 260/409 |
| 3,123,627 | 3/1964 | Flank et al. | 260/409 |
| 3,444,221 | 5/1969 | Voeste et al. | 260/409 |
| 3,634,471 | 1/1972 | Kehse | 260/409 |
| 3,792,067 | 2/1974 | Coombes et al. | 260/409 |
| 3,823,172 | 7/1974 | Leuteritz | 260/409 |
| 3,988,329 | 10/1976 | Zucker et al. | 260/409 |
| 4,163,750 | 8/1979 | Bird et al. | 260/409 |
| 4,385,001 | 5/1983 | Rosen | 252/472 |
| 4,424,162 | 1/1984 | Rosen | 260/409 |
| 4,424,163 | 1/1984 | Rosen | 260/409 |

*Primary Examiner*—Thomas A. Waltz

*Attorney, Agent, or Firm*—James R. Hoatson, Jr.; Eugene I. Snyder; William H. Page, II

[57] ABSTRACT

Selective continuous hydrogenations of fatty materials are possible over a fixed bed of zerovalent nickel on an alpha-alumina support. The selectivity of such continuous hydrogenations is further enhanced by performing such hydrogenations in an upflow mode. When soybean oil is used and hydrogenation is continued to an IV of about 110, the resulting partially hydrogenated soybean oil is comparable in its solids content to that obtained in a batch hydrogenation using presently conventional commercial catalysts.

13 Claims, No Drawings

CONTINUOUS REDUCTION OF EDIBLE OILS

BACKGROUND OF THE INVENTION

Although some edible oils are used per se, by far the largest portion are hydrogenated, or hardened, prior to their end use. The reason for such hydrogenation is to increase the stability of the final product. For example, processed soybean oil is susceptible to oxidation resulting in deterioration of its organoleptic properties upon storage even at ambient temperature. Where the oil is to be used at higher temperatures, for example, as a frying oil, the adverse organoleptic consequences of oxidation become even more pronounced.

The commonly accepted origin of oxidative deterioration is the presence of highly unsaturated components, such as the triene moiety, linolenate, in soybean oil. Partial hydrogenation to remove most of this component leads to a marked increase in the oxidative stability of the resulting product, thereby facilitating storage and permitting unobjectionable use at higher temperatures. Ideally, one desires this hydrogenation to be highly specific, reducing only triene to the diene, linoleate, without effecting cis to trans isomerization. In practice, this goal is unachievable.

The fats and oils which are the subject of this invention, hereinafter collectively referred to as fatty materials, are triglycerides of fatty acids, some of which are saturated and some of which are unsaturated. In vegetable oils, the major saturated fatty acids are lauric (12:0), myristic (14:0), palmitic (16:0), stearic (18:0), arachidic (20:0), and behenic (22:0) acids. The notation, "18:0," for example, means an unbranched fatty acid containing 18 carbon atoms and O double bonds. The major unsaturated fatty acids of vegetable oils may be classified as monounsaturated, chief of which are oleic (18:1) and erucic (22:1) acids, and polyunsaturated, chief of which are the diene, linoleic acid (18:2) and the triene, linolenic acid (18:3). Unhardened vegetable fats and oils contain virtually exclusively cis-unsaturated acids.

In the context of partial hydrogenation, the ultimate goal is the reduction of triene to diene without attendant trans acid formation or saturate formation. In practice, it is observed that partial reduction results in lowering both triene and diene and increasing the monoene, saturate, and trans levels. Because it is desired that the product of partial hydrogenation itself be a liquid oil relatively free of sediment or even cloudiness upon storage at, for example, 10° C., the formation of saturated and trans acids in such hydrogenation is a vexing problem. Removal of these solids, whose relative amount is measured by the Solid Fat Index (SFI), is a relatively costly and inefficient process attended by large losses associated with the separation of gelatinuous solids from a viscous liquid. It is known in the art that such solids are composed largely of triglycerides containing at least one saturated fatty acid moiety and/or trans monounsaturated fatty acid moiety with the predominant culprits having at least 18 carbon atoms. It is further known in the art that fatty acid analysis alone may be an insensitive analytical tool, that is to say, two products of hydrogenation of, for example, soybean oil may show different SFI profiles while having virtually identical fatty acid analysis. This arises because of the distribution of the saturated moieties in the triglyceride is important. The solubility in the soybean oil of disaturated triglycerides is much less than twice the amount of monounsaturated triglycerides, and the solubility of monounsaturated triglycerides may depend upon whether the other fatty acid moieties of the triglyceride are monounsaturated, diunsaturated, etc., and may also depend upon whether the saturated portion is at the one- or two-position of the triglyceride. Hence, hydrogenation of edible fats and oils is largely an empirical process, whose analytical tools include Solid Fat Index (SFI) supported by fatty acid analysis. The difficulty of achieving desirable results, in the context of selectivity in Solid Fat Index, has largely limited such hydrogenation to a batch type process. Although the transition from a batch to a continuous process, especially of the fixed bed type, is conceptually facile, it will be recognized by the skilled worker that impediments have been substantial.

Thus, U.S. Pat. No. 2,971,016 describes the vapor-phase hydrogenation of unsaturated fatty acids and esters in a fluidized bed, which enabled the disadvantages of liquid phase hydrogenation and the use of solid bed catalysts to be avoided. It will be recognized that vapor-phase hydrogenation is unfeasible for oils and fats. A continuous process based on a mixture of oil and suspended catalyst flowing along a tortuous path on the top surface of a series of perforated plates, with hydrogen admitted through the bottom face counter-current to the oil flow and minimum mixing along the various plates, is the subject of U.S. Pat. No. 3,634,471. The process described in U.S. Pat. No. 3,792,067, which has had limited commercial application, is based on a turbulent two-phase gas-liquid flow with minimal back-mixing, the liquid phase consisting of oil containing catalyst suspended therein. Both U.S. Pat. Nos. 3,823,172 and 3,988,329 describe continuous hydrogenation processes where the flowing mass of oil containing suspended catalyst is subject to high shear forces. U.S. Pat. No. 3,444,221 describes a continuous process which requires a high ratio of liquid (catalyst suspended in oil) to gas phase using a plurality of reaction chambers.

The processes represented in the latter four references all suffer from the common disadvantage of necessitating the additional unit process of removal of suspended catalyst from partially hydrogenated oil, as by filtration. It is well known in the art that this unit process entails substantial product loss and requires use of relatively large amounts of filter aid, which adds to processing cost and presents subsequent disposal problems. Because use of a fixed bed continuous operation obviates the necessity of catalyst removal, such a mode of operation is greatly preferred. Both U.S. Pat. Nos. 3,123,626 and 3,123,627 describe fixed bed processes using sulfur—or nitrogen-poisioned nickel respectively, on a macroporous silica support. At least in part, success of the method is attributable to the large pore structure of the support with catalyst contained within the pores. A diametrically opposed approach to fixed bed hydrogenation is described in U.S. Pat. No. 4,163,750, where metals, including nickel, are deposited almost entirely on the outer surfaces of the particles of the support. The support itself may be porous, and in fact advantages are ascribed to porous supports, such as porous carbon, as compared with non-porous supports, as stainless steel. The method of achieving surface deposition of the metal, which appears to be critical to the success of this process, does not seem to be disclosed.

The observation upon which the subject invention of this application is founded is that alpha-alumina of low surface area and low porosity functions as an effective support for catalytically active zerovalent nickel in a fixed bed hydrogenation of edible fats and oils, affording partially hydrogenated product with the desired selectivity. This observation seems unknown in the prior art, and stands in sharp contrast to the prior art requirements of a porous support. A further observation enhancing this invention is that the selectivity of hydrogenation of fatty materials is substantially improved when the fatty material is passed upflow over the fixed bed.

It is an object of this invention to provide a method of selective hydrogenation of fatty materials by a continuous process. An embodiment comprises hydrogenating a vegetable oil flowing upwardly over a fixed bed of a hydrogenation catalyst consisting essentially of catalytically active zerovalent nickel impregnated on alpha-alumina. In a more specific embodiment, the alumina has a surface area less than about 5 square meters per gram. In a still more specific embodiment, the nickel is present at a level from about 1 to about 25% based on alpha-alumina.

DESCRIPTION OF THE INVENTION

The subject matter disclosed is a method of hydrogenating a fatty material comprising contacting an upwardly flowing mass of said fatty material with a fixed bed of catalyst consisting essentially of zerovalent nickel on alpha-alumina whose surface area is less than about 10 $m^2/g$ and whose micropore volume is less than about 0.1 ml/g at a temperature from about 150° to about 250° C. in the presence of hydrogen at a pressure from about 5 to about 150 psig and recovering the resulting hydrogenated product.

The method described herein is generally applicable to fatty materials and is especially applicable to edible oils and fats. Because the partial hydrogenation of liquid oils to afford hardened, but still liquid, oils occupies a prominent part within the domain of hydrogenation of edible oils and fats, the method of this invention is particularly applicable to such partial hydrogenation. Thus, the described method of hydrogenation is especially useful to partially harden edible liquid oils whereby the iodine value (IV) is lowered from about 10 to about 30 units by hydrogenation, whereby the increase in saturates attending hydrogenation is less than about 1.5%, and whereby the triene level is reduced to about 3% or less. Such a partially hydrogenated product preferably has an SFI of less than about 5±1 at 50° F., less than about 2±0.5 at about 70° F., less than about 1.0±0.5 at 80° F., and 0+0.2 at 92° F. The term "iodine value" is a measure of the total extent of unsaturation in an edible oil or fat as performed by a standard test. In the context of soybean oil, which is a particularly important liquid vegetable oil, partial hardening is continued to an IV drop of from about 15 to about 25 units, with the product having less than about 6% stearate and about 3% linolenate or less.

The method of this invention is especially applicable to liquid vegetable oils. Examples of such oils include soybean oil, cottonseed oil, sunflower oil, safflower oil, rapeseed oil, corn oil, and liquid fractionations from palm oil. The application of this method to soybean oil is especially important. As will be recognized by those skilled in the art, partial hydrogenation of liquid oils to afford partially hardened liquid oils is especially demanding, hence it is to be expected that a method suitable for this task also is suitable for more extensive hydrogenation. Thus, the method described herein also is suitable for more extensive hydrogenation, where the IV of the product may be as low as about 70. Oils and fats which can be so hydrogenated include those above, their partially hydrogenated products, and also such feedstocks as palm oil.

The hydrogenation catalyst used in this method is essentially catalytically active zerovalent nickel deposited on alpha-alumina. It is to be understood that by alpha-alumina is meant alumina whose crystallinity as measured by X-ray diffraction corresponds to that characterized in ASTM file number 10-173. Although zerovalent nickel is widely used in this art area, it is generally used on supports, such as kieselguhr and alumina, of high surface area and large porosity. A discovery of this invention is that continuous hydrogenation using zerovalent nickel in a fixed bed mode can be successfully performed, in the context of the criteria elaborated above, only on supports characterized by relatively low surface area and porosity. In particular, the hydrogenation catalyst of this method consists essentially of catalytically active zerovalent nickel on alpha-alumina with a surface area less than about 10 $m^2$ per gram, with a surface area less than about 5 $m^2$ per gram preferred. Additionally, the micropore volume of the support must be less than about 0.1 ml/g, with those supports having a micropore volume less than about 0.05 ml/g, being advantageous. The macropore volume of the supports used in this invention is related to the surface area of the support. Consequently the supports used herein are further characterized by a macropore volume less than about 0.6 ml/g, with a macropore volume under about 0.3 ml/g being preferred. By micropore volume is meant the total volume of pores under about 117 angstroms in size; by macropore volume is meant the total volume of pores greater than about 117 angstroms in size.

It is believed that, because of transport problems associated with fatty materials in the smaller pores, the selectivity in hydrogenation of a catalyst of a given surface area, micro- and macropore volume will change with macropore distribution. In particular, it is believed that a distribution skewed toward relatively large pore sizes will favor selectivity. As an example, with other variables being held constant it is believed that a catalyst whose support contains 90% of its macropores larger than about 3500 anstroms will be more selective than one where 90% of the macropores are larger than 300 angstroms, but only 10% larger than 3500 angstroms.

The concentration of nickel may range from 1 to about 25 percent by weight of alumina. The choice of nickel loading will depend, inter alia, on the degree of selectivity and catalyst life desired in a particular operation.

Hydrogenations are conducted at a temperature from about 150° to about 250° C., with the range of 175° to 225° C. being preferred. Hydrogenations may be conducted at pressures up to about 150 psig. Frequently there is some advantage to conducting such hydrogenations at a pressure less than about 50 psig, and a pressure from about 5 to about 45 psig often is preferred.

A discovery of this invention is that the selectivity of hydrogenation of fatty materials with the catalyst of this invention is substantially enhanced when the fatty material is passed upflow over the catalyst bed as compared to fatty material passed downflow. By downflow is meant that the feedstock flows with gravity, that is, a trickle bed operation. By upflow is meant that the feedstock is made to flow against gravity, as in a flooded bed operation. In particular, the difference in selectivity between upflow and downflow operation may spell the difference between commercial success and failure. Although the reason for enhanced selectivity in the upflow mode is not known with certainty, it may arise from an overabundance of hydrogen at the catalyst surface in the downflow mode relative to a flooded bed operation.

One index of selectivity as used herein is the Solid Fat Index, as described above. Obtaining SFI data for large numbers of samples is laborious and time consuming. Another index of selectivity relied upon here and commonly used elsewhere can be better understood from the following partial reaction sequence, where k is the rate constant for the indicated hydrogenation step.

$$18{:}3 \xrightarrow{k_3} 18{:}2$$

$$18{:}2 \xrightarrow{k_2} 18{:}1$$

$$18{:}1 \xrightarrow{k_1} 18{:}0$$

$$S_{LN} = k_3/k_2$$
$$S_{LO} = k_2/k_1$$

$^{S}$LN is termed the linolenate selectivity; a high value is characterized by relatively high yields of dienoic acid in the reduction of an unsaturated triglyceride containing trienoic acids. $^{S}$LO is the linoleate selectivity; a high value is characterized by relatively high yields of monoenoic acid in a reduction of an unsaturated triglyceride containing dienoic acids. An oil such as soybean oil contains both trienoic and dienoic acids, thus $^{S}$LN and $^{S}$LO may be measured simultaneously.

In the context of linolenate and linoleate selectivity, in a continuous method of hydrogenation as described herein where fatty material is passed upflow over a fixed catalyst bed, $^{S}$LN usually is greater than about 2, and $^{S}$LO usually is greater than 10, and generally will be greater than about 15.

The following description is applicable to a fixed bed operation, although it will be recognized that by suitable changes it may also be applicable to expanded or fluidized bed operation. The catalyst bed may be in the form of pellets, granules, spheres, extrudate, and so forth. The reactor is heated to the desired reaction temperature in a hydrogen atmosphere, often with a small hydrogen flow. After attainment of the desired temperature, the feedstock of edible fats and oils is pumped to flow upwardly over the fixed bed. The flow rate of the oil may be from about 0.2 to about 20 LHSV depending upon the degree of hydrogenation sought. When the flow of edible fats and oils is initiated, it is desirable to mix the hydrogen with said fats and oils so as to maintain the desired pressure. Often it is advantageous to admit excess hydrogen, maintaining pressure by partial venting. As the reaction proceeds and the activity of the catalyst bed decreases, adjustments may be made either in the LHSV or the temperature to maintain the desired characteristics of the product. Partially hardened oil is recovered as the effluent in a state suitable for further processing, such as blending, bleaching, or deodorization.

The examples herein are cited for illustrative purposes only and are not to be construed as limiting this invention in any way.

EXAMPLES 1-4

All hydrogenations were conducted in a reactor of conventional design containing a fixed bed of about 50 ml. catalyst. The reactor had a preheater section for bringing feedstock to temperature and a heater for the reaction zone. The feedstock, which was soybean oil in these samples, was passed by a metering pump either upflow or downflow and mixed with hydrogen before the preheater stage. In all cases there was a net excess of hydrogen, that is, hydrogen in excess of that necessary for reaction was introduced into the reaction zone and excess hydrogen was vented so as to maintain a constant pressure.

Iodine values were determined by AOCS method CD1-25 or were calculated from the measured fatty acid distribution. Solid fat index was determined by AOCS method CD10-57. Fatty acid distribution was determined by AOCS method CE2-66. Macropore volume was determined by the mercury intrusion method as described in ANSI/ASTM D 2873-10 using the porosimeter of U.S. Pat. No. 3,158,020.

The catalyst used in all runs consisted of 5% nickel on alpha-alumina, of surface area 3 $m^2/g$ in the form of 1/16" spheres. It was prepared by mixing the alumina with an aqueous solution of nickel nitrate hexahydrate, evaporating the water while mixing, calcining the resulting solid at 450° C. in air for 3-4 hours, then reducing the material in hydrogen for 2-4 hours at the same temperature. The alpha-alumina had the following macropore volume characteristics (in ml/g): 117-500 Angstroms, 0.0000; 500-1000 Angstroms, 0.0003; 1000-3500 Angstroms, 0.0000; 3500-17,500 Angstroms, 0.2037; 17,500-58,333 Angstroms, 0.0000. The micropore volume was less than about 0.03 ml/g.

Results of some typical hydrogenations are given in Table 1. Each period of an example corresponds to a four hour time interval. The SFI of some representative samples from upflow hydrogenation are given in Table 2. Values of $^{S}$LN, $^{S}$LO were calculated using a computer program furnished by the U.S. Department of Agriculture, Northern Regional Laboratories, as described in *J. Amer. Oil Chemists Soc.*, 56, 664 (1979).

TABLE 1

Continuous Hydrogenation of Soybean Oil

| Period | P,$H_2$ (psig) | T,(°C.) | LHSV | $H_2$ flow SCF/hr | 18:3 | 18:2 | 18:1 | 18:0 | 16:0 | IV (calc) | % Trans | $S_{LN}$ | $S_{LO}$ |
|---|---|---|---|---|---|---|---|---|---|---|---|---|---|
| Example 1, Downflow | | | | | | | | | | | | | |
| 2-4 | 25 | 195 | 6 | 0.4 | 4.2 | 37.6 | 36.4 | 10.8 | 11.1 | 107.2 | | 1.3 | 1.9 |
| 5-10 | 10 | 195 | 6 | 0.4 | 5.0 | 43.8 | 32.9 | 7.4 | 11.2 | 117.1 | | 1.5 | 2.0 |
| 11-15 | 10 | 210 | 6 | 0.4 | 4.5 | 43.0 | 34.1 | 7.8 | 10.5 | 115.6 | | 1.7 | 2.4 |
| 16-19 | 10 | 210 | 8 | 0.4 | 5.5 | 47.1 | 30.6 | 6.2 | 10.5 | 122.3 | | 1.6 | 2.5 |
| 20-33 | 10 | 210 | 4 | 0.4 | 3.9 | 41.2 | 36.0 | 8.3 | 10.6 | 112.6 | | 1.8 | 2.6 |
| 34-39 | 50 | 195 | 6 | 0.4 | 4.9 | 44.2 | 32.0 | 8.5 | 10.5 | 116.9 | | 1.6 | 1.7 |
| 40-45 | 50 | 165 | 6 | 0.4 | 5.8 | 48.1 | 28.5 | 6.9 | 10.7 | 123.1 | | 1.6 | 1.4 |
| 46-48 | 10 | 165 | 6 | 0.4 | 6.4 | 50.9 | 27.0 | 5.1 | 10.6 | 128.1 | | 1.7 | 2.2 |

TABLE 1-continued

| Period | P.$H_2$ (psig) | T.(°C.) | LHSV | $H_2$ flow SCF/hr | 18:3 | 18:2 | 18:1 | 18:0 | 16:0 | IV (calc) | % Trans | $S_{LN}$ | $S_{LO}$ |
|---|---|---|---|---|---|---|---|---|---|---|---|---|---|
| Continuous Hydrogenation of Soybean Oil | | | | | | | | | | | | | |
| 49–51 | 10 | 165 | 4 | 0.4 | 5.8 | 49.4 | 28.9 | 5.5 | 10.5 | 125.4 | | 1.9 | 2.7 |
| 52–54 | 50 | 165 | 4 | 0.4 | 5.2 | 45.5 | 30.7 | 8.1 | 10.5 | 118.7 | | 1.6 | 1.6 |
| 55–58 | 50 | 195 | 6 | 0.4 | 5.3 | 45.4 | 30.6 | 8.3 | 10.5 | 118.7 | | 1.5 | 1.5 |
| Example 2, Downflow | | | | | | | | | | | | | |
| 1–10 | 50 | 150 | 6 | 0.4 | 4.7 | 40.2 | 34.7 | 9.3 | 11.2 | 111.6 | | 1.3 | 1.9 |
| 11–16 | 50 | 180 | 6 | 0.8 | 3.5 | 32.2 | 37.6 | 15.5 | 11.2 | 97.2 | | 1.2 | 1.7 |
| 19–20 | 25 | 180 | 6 | 0.8 | 4.4 | 42.3 | 34.3 | 8.6 | 10.5 | 114.1 | | 1.7 | 2.1 |
| 21–24 | 10 | 180 | 6 | 0.8 | 5.0 | 46.4 | 31.9 | 6.1 | 10.7 | 120.7 | | 1.9 | 2.8 |
| 25–28 | 10 | 180 | 4 | 0.4 | 4.4 | 44.7 | 33.8 | 6.5 | 10.6 | 118.1 | | 2.0 | 3.2 |
| 29–32 | 25 | 180 | 4 | 0.4 | 4.1 | 42.4 | 34.9 | 8.1 | 10.5 | 114.2 | | 2.9 | 2.4 |
| 33–35 | 50 | 180 | 4 | 0.4 | 3.8 | 38.6 | 35.6 | 11.4 | 10.5 | 107.5 | | 1.6 | 1.8 |
| 36–38 | 50 | 150 | 6 | 0.4 | 6.1 | 48.1 | 28.2 | 6.8 | 10.9 | 123.3 | | 1.3 | 1.3 |
| 39–40 | 50 | 180 | 4 | 0.4 | 4.3 | 41.0 | 33.9 | 10.3 | 10.4 | 111.5 | | 1.6 | 1.7 |
| 41–44 | 50 | 180 | 3 | 0.4 | 3.7 | 38.4 | 37.9 | 10.1 | 10.5 | 108.3 | | 1.6 | 2.3 |
| Example 3, Upflow | | | | | | | | | | | | | |
| 1–10 | 50 | 195 | 3 | 0.4 | 2.1 | 40.0 | 41.9 | 5.1 | 10.5 | 111.4 | 28.6 | 3.2 | 15.9 |
| 11–16 | 50 | 195 | 1 | 0.4 | 0.1 | 20.2 | 59.9 | 9.5 | 10.3 | 86.9 | 43.0 | 3.8 | 10.4 |
| 17–22 | 50 | 195 | .8 | 0.4 | — | 14.7 | 63.0 | 12.0 | 10.3 | 79.6 | 46.4 | 3.1 | 9.5 |
| 23–28 | 50 | 195 | .6 | 0.4 | — | 8.1 | 66.8 | 14.6 | 10.5 | 71.5 | 44.9 | 1.9 | 11.0 |
| 29–34 | 30 | 195 | .5 | 0.4 | 0.1 | 10.6 | 67.2 | 11.6 | 10.4 | 76.4 | 45.3 | 2.4 | 13.3 |
| 35–38 | 50 | 210 | 1 | 0.4 | — | 17.4 | 63.1 | 9.1 | 10.5 | 84.3 | 47.4 | 3.3 | 13.2 |
| 39–42 | 50 | 210 | .6 | 0.4 | — | 0.4 | 68.7 | 20.4 | 10.5 | 59.7 | 43.3 | 0.7 | 25.5 |
| 43–56 | 30 | 210 | .6 | 0.4 | — | 10.6 | 69.7 | 9.4 | 10.4 | 78.2 | 48.0 | 2.1 | 19.2 |
| 57–72 | 30 | 215 | .6 | 0.4 | — | 10.6 | 70.6 | 8.6 | 10.3 | 79.0 | 50.5 | 2.1 | 24.9 |
| 73–78 | 30 | 220 | .6 | 0.4 | — | 11.5 | 70.5 | 7.7 | 10.3 | 80.6 | 51.9 | 2.5 | 29.3 |
| 79–82 | 50 | 195 | 1 | 0.4 | 0.5 | 37.4 | 46.4 | 5.5 | 10.5 | 105.8 | 45.9 | 5.3 | 16.0 |
| 83–92 | 50 | 225 | .6 | 0.4 | 0.1 | 19.7 | 60.3 | 9.7 | 10.2 | 86.1 | 51.8 | 3.7 | 10.6 |
| 93–98 | 50 | 235 | .6 | 0.4 | 0.1 | 16.2 | 63.5 | 9.9 | 10.3 | 82.8 | 51.6 | 3.1 | 12.4 |
| 99–102 | 50 | 195 | .6 | 0.4 | — | 28.6 | 54.3 | 6.8 | 10.4 | 92.2 | 52.9 | 5.4 | 13.6 |
| Example 4, Upflow | | | | | | | | | | | | | |
| 1–10 | 50 | 195 | 3 | 0.4 | 3.0 | 41.1 | 41.0 | 5.0 | 10.0 | 114.0 | 27.7 | 2.4 | 65.0 |
| 11–16 | 30 | 195 | .6 | 0.4 | — | 16.5 | 63.0 | 10.3 | 10.2 | 82.7 | 45.7 | 3.1 | 11.5 |
| 17–20 | 30 | 195 | .6 | 0.1 | 0.5 | 27.9 | 55.0 | 6.6 | 10.2 | 96.6 | 42.8 | 3.3 | 17.2 |
| 21–24 | 30 | 205 | .6 | 0.4 | 0.5 | 13.9 | 64.2 | 11.4 | 10.2 | 80.4 | 46.1 | 1.7 | 11.4 |
| 25–28 | 30 | 215 | .6 | 0.4 | — | 0.6 | 75.0 | 14.2 | 10.2 | 65.5 | 46.3 | 0.8 | 38.3 |
| 29–32 | 30 | 195 | .6 | 0.4 | — | 13.2 | 66.9 | 9.9 | 10.1 | 80.2 | 47.1 | 2.7 | 15.9 |
| 33–39 | 30 | 225 | .6 | 0.4 | — | 0.5 | 75.1 | 14.3 | 10.2 | 65.3 | 46.1 | 0.7 | 44.3 |
| 37–48 | 30 | 235 | .6 | 0.4 | — | 1.9 | 70.5 | 15.5 | 10.4 | 64.0 | 45.5 | 1.1 | 20.4 |
| 49–52 | 30 | 195 | .6 | 0.4 | — | 11.5 | 68.6 | 9.3 | 10.7 | 78.9 | 48.2 | 2.4 | 17.9 |
| 53–62 | 30 | 235 | .6 | 0.4 | — | 6.7 | 71.7 | 11.0 | 10.5 | 73.5 | 48.7 | 1.8 | 19.8 |
| 63–66 | 30 | 240 | .6 | 0.4 | — | 9.4 | 71.3 | 9.0 | 10.4 | 77.6 | 51.0 | 2.2 | 23.7 |
| 67–70 | 30 | 245 | .6 | 0.4 | — | 6.2 | 73.8 | 9.8 | 10.3 | 74.2 | 50.2 | 1.8 | 26.9 |
| 71–74 | 30 | 250 | .6 | 0.4 | — | 3.2 | 74.9 | 11.5 | 10.5 | 69.8 | 49.8 | 1.3 | 27.6 |
| 75–78 | 30 | 195 | .6 | 0.4 | 0.3 | 20.0 | 62.7 | 6.8 | 10.4 | 89.1 | 51.9 | 2.7 | 23.1 |

TABLE 2

| Solid Fat Index of Upflow Hydrogenation Products | | | | |
|---|---|---|---|---|
| IV | | 109 | 75 | 69 |
| SFI: | 50° F. | 4.5 | 52 | 52 |
| | 70° F. | 1.7 | 40 | 41 |
| | 80° F. | 0.6 | 33 | 36 |
| | 92° F. | 0 | 18 | 22 |
| | 104° F. | 0 | 2.7 | 6.9 |

As is clearly shown by comparison of $^{S}$LN, $^{S}$LO measured in the upflow and downflow modes, the selectivity of continuous hydrogenation to various IV levels is substantially enhanced when hydrogenation is performed upflow.

What is claimed is:

1. A continuous method for the selective hydrogenation of a fatty material which comprises contacting an upwardly flowing mass of the fatty material at a temperature from about 150° to about 250° C. in the presence of hydrogen at a pressure up to about 150 psig with a fixed mass of catalyst consisting essentially of catalytically active zerovalent nickel on alpha-alumina having a surface area less than about 10 $m^2/g$ and a micropore volume less than about 0.1 ml/g, and recovering the resultant hydrogenated product.

2. The method of claim 1 wherein said fatty material is a liquid vegetable oil.

3. The method of claim 2 wherein said liquid vegetable oil is selected from the group consisting of soybean oil, cottonseed oil, rapeseed oil, sunflower oil, corn oil, safflower oil, and liquid fractions from palm oil.

4. The method of claim 2 wherein said oil is soybean oil and the contacting thereof with said catalyst is of duration sufficient to lower the iodine value from about 10 to about 30 units.

5. The method of claim 1 wherein the catalyst contains from about 1 to about 25% nickel.

6. The method of claim 1 wherein the surface area is less than about 5 $m^2/g$.

7. The method of claim 6 wherein the surface area is about 3 $m^2/g$.

8. The method of claim 1 wherein the micropore volume is less than about 0.05 ml/g.

9. The method of claim 1 wherein the alpha-alumina is further characterized by a macropore volume less than about 0.6 ml/g.

10. The method of claim 9 where said macropore volume is less than about 0.3 ml/g.

11. The method of claim 1 wherein the temperature is from about 175° to about 225° C.

12. The method of claim 1 wherein the hydrogen pressure is less than about 50 psig.

13. The method of claim 12 wherein the hydrogen pressure is from about 5 to about 45 psig.

* * * * *